US012582183B1

(12) United States Patent
Carter

(10) Patent No.: US 12,582,183 B1
(45) Date of Patent: Mar. 24, 2026

(54) BUSTLE DEVICE TO BE RECEIVED UNDER GARMENTS

(71) Applicant: Miles Brandon Carter, Valley stream, NY (US)

(72) Inventor: Miles Brandon Carter, Valley stream, NY (US)

( * ) Notice: Subject to any disclaimer, the term of this patent is extended or adjusted under 35 U.S.C. 154(b) by 0 days.

(21) Appl. No.: 18/897,263

(22) Filed: Sep. 26, 2024

(51) Int. Cl.
*A41F 19/00* (2006.01)
*A41D 15/00* (2006.01)

(52) U.S. Cl.
CPC ..... *A41F 19/00* (2013.01); *A41D 15/002* (2013.01); *A41F 19/005* (2013.01)

(58) Field of Classification Search
CPC ..... A41F 19/00; A41F 19/005; A41D 15/002
See application file for complete search history.

(56) References Cited

U.S. PATENT DOCUMENTS 316,712 A * 4/1885 Whiting ..... A41F 19/005 24/518
467,412 A * 1/1892 Harvey ..... A41F 19/005 24/15
623,058 A * 4/1899 Williams ..... A41F 19/005 24/15
732,942 A * 7/1903 Jackson ..... A41F 19/005 2/269
1,782,057 A * 11/1930 Bollinger ..... A41F 19/005 24/301
2,687,530 A * 8/1954 Farnum ..... A41D 15/002 2/217
4,149,275 A * 4/1979 Sanchez ..... A41D 1/06 2/269
5,787,511 A * 8/1998 Garside ..... A41F 19/005 2/232
11,992,074 B2 * 5/2024 Wenkman ..... A41F 17/00
2009/0235434 A1 * 9/2009 Ratcliffe ..... A41D 15/002 2/269
2010/0299802 A1 * 12/2010 Bailey ..... A41F 19/005 2/269
2012/0297524 A1 * 11/2012 Stem ..... A41F 19/00 2/338
2014/0223638 A1 * 8/2014 Canady ..... A41D 1/14 2/223
2019/0053558 A1 * 2/2019 Spencer ..... A41F 17/00

FOREIGN PATENT DOCUMENTS

WO WO-2014046554 A1 * 3/2014 ..... F16B 7/105

* cited by examiner

*Primary Examiner* — Khaled Annis

(57) ABSTRACT

A bustle device is disclosed herein. The bustle device comprises a cylindrical detent casing comprising a plurality of detent grooves. The cylindrical detent casing is hollow. The bustle device further comprises a cylindrical telescoping member movably disposed at a first end of the cylindrical detent casing. The cylindrical telescoping member comprises a projection to be received into a particular detent groove of the plurality of detent grooves of the cylindrical detent casing. The cylindrical telescoping member comprises a first connector to be detachably connected to a top side of a garment. Moreover, the bustle device comprises a U-shaped member connected to a second end of the cylindrical detent casing. The U-shaped member comprises a second connector to be detachably connected to a bottom side of a garment.

10 Claims, 7 Drawing Sheets

BUSTLE DEVICE TO BE RECEIVED UNDER GARMENTS

FIELD OF THE INVENTION

The present invention relates to a bustle device comprising a cylindrical detent casing with detent grooves, a telescoping member with a projection for engagement with the detent grooves and a U-shaped member. The telescoping member and the U-shaped member comprise connectors for attaching the bustle device to a garment.

BACKGROUND OF THE INVENTION

Generally, in settings such as fashion design, theatrical costumes and historical reenactments, the silhouette of garments such as costumes employed therein is required to be altered to achieve specific aesthetic effects. Further, for people wearing long forms of garments such as long skirts, long frocks and such, there is a requirement to raise a bottom seam of such garments for various purposes, including but not limited to, improving walking comfort for the wearer, preventing damage to the garments, preventing spoilage of the garment through contact of dust, soil, water and so forth.

Traditionally, wearers have employed means such as using pads or static supports. However, in situations where frequent adjustments or varying levels of support may be required, such traditional methods are impractical as the manual adjustment tools and static supports fail to provide the required flexibility. Additionally, such methods complicate the process of maintaining the desired garment silhouette and also fail to offer a straightforward means for secure attachment and detachment from different parts of the garment. Thus, traditional methods of adjusting the silhouette of garments can be cumbersome and lack flexibility as such solutions often do not allow the wearer to easily adjust and reposition the employed means, making them inconvenient for the wearers.

In response to these needs and address the aforementioned issues, there is a clear need for innovative undergarment support devices that offer easy adjustability, secure attachment and versatile application. Such devices should enhance the flexibility and functionality of garment support while ensuring ease of use and reliable performance.

BRIEF SUMMARY OF THE INVENTION

The invention relates to bustle devices for use under garments, specifically focusing on a device that allows for adjustable support and alteration of garment silhouettes. The device is intended to enhance flexibility and functionality of garment adjustments in various settings.

According to a first embodiment, the bustle device comprises a cylindrical detent casing that comprises a plurality of detent grooves. The cylindrical detent casing is hollow. Further, one end of the cylindrical detent casing comprises a cylindrical telescoping member attached thereto. The cylindrical telescoping member comprises a projection designed to engage with the detent grooves for secure positioning. The cylindrical telescoping member comprises a first connector for detachable attachment to the top side of a garment. Moreover, an opposite end of the cylindrical detent casing comprises a U-shaped member attached thereto. The U-shaped member comprises a second connector for detachable attachment to the bottom side of the garment.

The bustle device further comprises options for the type of projection, which can be selected from ball, pin, hook or magnetic projections. The projection may be spring-loaded and the device may incorporate a locking mechanism to secure the projection in a chosen detent groove. Additionally, the U-shaped member may comprise an elongate extension member positioned at an angle relative to the cylindrical telescoping member. The first and second connectors can be various types such as clips, hooks, snap fasteners, magnetic fasteners, hook and loop fasteners (such as VELCRO® fasteners), buttons, buckles, or clamps.

The bustle device addresses the need for a versatile and adjustable garment support solution, offering easy modification of garment silhouettes and secure attachment to various parts of the garment. Such a design improves flexibility, functionality and ease of use, providing a more effective solution for managing garment adjustments across different applications.

BRIEF DESCRIPTION OF DRAWINGS

Notwithstanding any other forms which may fall within the scope of the present invention, preferred embodiments of the disclosure will now be described, by way of example only, with reference to the accompanying drawings in which: to the drawings, in which.

DETAILED DESCRIPTION OF THE EMBODIMENTS

The example embodiments herein and the various features and advantageous details thereof are explained more fully with reference to the non-limiting embodiments that are illustrated in the accompanying drawings and detailed in the following description. Descriptions of well-known components and processing techniques are omitted to not unnecessarily obscure the embodiments herein. The description herein is intended merely to facilitate an understanding of ways in which the example embodiments herein can be practiced and to further enable those of skill in the art to practice the example embodiments herein. Accordingly, this disclosure should not be construed as limiting the scope of the example embodiments herein.

Figure 1:
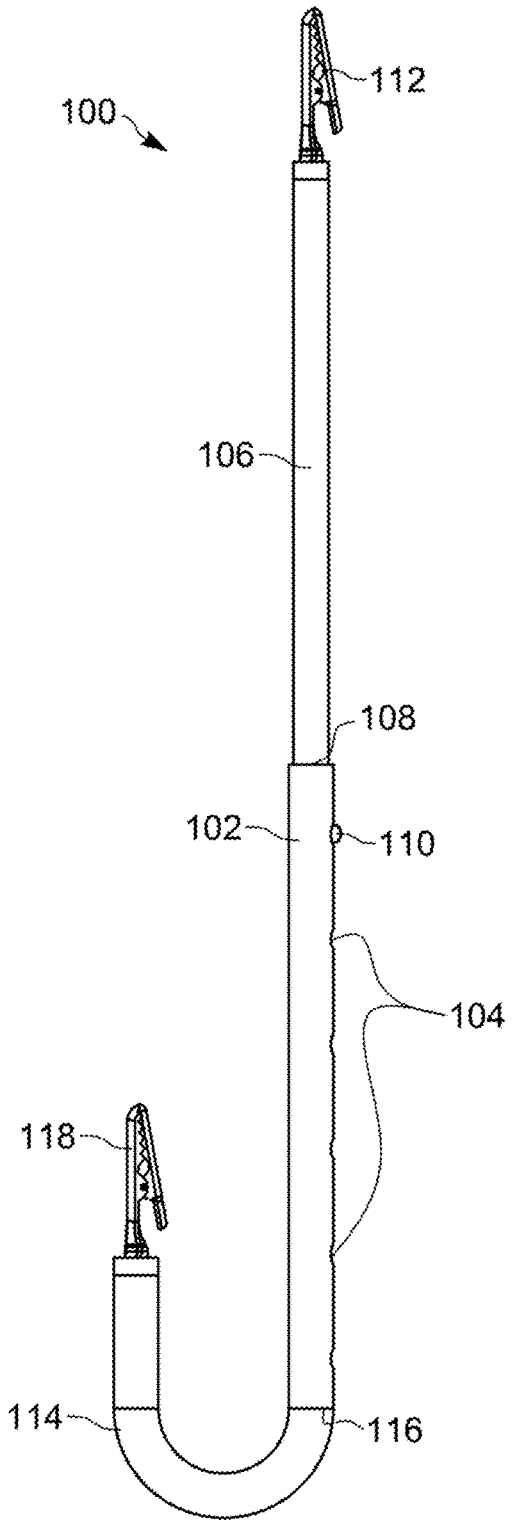
FIG. 1 shows a right-hand side view of a bustle device to be received under a garment, in accordance with an embodiment of the present disclosure.

Referring to FIG. 1, there is shown a right-hand side view of a bustle device 100 to be received under a garment, in accordance with an embodiment of the present disclosure. The bustle device 100 provides adjustable support and alteration of garment silhouettes, thereby, improving walking comfort for the wearer of the garment, preventing damage to the garments (such as a lower hem of a long skirt), preventing spoilage of the garment through contact of a bottom side of the garment with dust, soil, water and so forth.

The bustle device 100 comprises a cylindrical detent casing 102 that comprises a plurality of detent grooves 104. The term "cylindrical detent casing 102" as used throughout the present disclosure refers to a hollow structural component that accommodates other components of the bustle device 100 therein. The cylindrical detent casing 102 ensures stability and precise alignment of such other components of the bustle device 100, accommodating changes in garment support requirements (such as, to the silhouette of the garment). The term "detent groove 104" as used throughout the present disclosure relates to a through-hole formed in a body of the cylindrical detent casing 102. The plurality of detent grooves 104 enable adjustable positioning of other components of the bustle device 100 with respect to the cylindrical detent casing 102.

The bustle device 100 further comprises a cylindrical telescoping member 106 movably disposed at a first end 108 of the cylindrical detent casing 102. The term "cylindrical telescoping member 106" refers to a component that can extend or retract within the cylindrical detent casing 102 to adjust a length of support provided to the wearer of the garment. The cylindrical telescoping member 106 includes a projection 110 that engages with a specific detent groove 104 of the cylindrical detent casing 102. The term "projection 110" as used throughout the present disclosure refers to a component that locks into one of the plurality of detent grooves 104 to secure the telescoping member 106 at a desired length. The cylindrical telescoping member 106 comprises a first connector 112 for detachable connection of the bustle device 100 to a top side of the garment. The term "first connector 112" refers to a fastening component that attaches the telescoping member 106 to the garment, allowing for easy detachment when needed.

Additionally, the bustle device 100 comprises a U-shaped member 114 connected to a second end 116 of the cylindrical detent casing 102. The term "U-shaped member 114" as used throughout the present disclosure refers to a component associated with a U-shaped profile that provides support to a bottom side of the garment. The U-shaped profile of the U-shaped member 114 enables to provide lift to the bottom side of the garment, thereby raising the bottom side towards the top side of the garment and preventing damage to the garment. The U-shaped member 114 comprises a second connector 118 for detachable connection to the bottom side of the garment. The term "second connector 118" refers to a fastening component that attaches the U-shaped member 114 to the garment, ensuring stability and support at the bottom side of the garment.

The cylindrical detent casing 102, the cylindrical telescoping member 106 and U-shaped member 114 together provide adjustable support and protection for the garment. The cylindrical telescoping member 106 can be extended or retracted to adjust a profile (such as a length) of the bustle device 100. The plurality of detent grooves 104 and the projection 110 ensure that the telescoping member 106 remains securely in place. The U-shaped member 114 enables to provide lift to the bottom side of the garment, enabling to maintain a required shape and silhouette of the garment.

In an embodiment, each detent groove of the plurality of detent grooves 104 is equidistantly from one another along the cylindrical detent casing 102. Such a uniform spacing between adjacent detent grooves enables to provide consistent and predictable adjustments of the cylindrical telescoping member 106 with respect to the cylindrical detent casing 102 by allowing the user to make fine-tuned adjustments through extension or retraction of the cylindrical telescoping member 106 within the cylindrical detent casing 102 and subsequent locking of the projection 110 within a required detent groove, thereby offering flexibility in altering the support and shape of the garment.

In another embodiment, the projection 110 is selected from a ball projection, a pin projection, a hook projection and a magnetic projection. It will be appreciated that each type of projection allows the cylindrical telescoping member 106 to engage with the detent grooves 104 in a distinct way. For example, a ball projection provides a smooth and rounded interface to engage with the plurality of detent grooves 104, thus, enabling easier adjustments. Further, a pin projection provides a precise and secure fit, thereby enhancing stability. Moreover, a hook projection engages with the grooves in a latch-like manner for a more robust hold. Additionally, a magnetic projection uses magnetic force to interact with the detent grooves 104, allowing for tool-free adjustments and simplifying the securing process.

In yet another embodiment, the projection 100 is spring-loaded with respect to the cylindrical telescoping member 106. The spring-loading mechanism improves convenience associated with removal of the projection 110 from detent groove and insertion of the projection 110 into another detent groove for adjustment. For example, during adjustment of the cylindrical telescoping member 106, the user presses the projection 110, enabling the spring-loaded projection 110 to compress and release the projection 110 from a specific detent groove. Subsequently, when the user releases the projection 110 upon placing the projection 110 within another detent groove, the cylindrical telescoping member 106 is securely locked with respect to the cylindrical detent casing 102. Thus, the spring-loaded mechanism enables easy and smooth adjustments by causing the projection 110 to securely lock into place.

In an embodiment, the bustle device 100 comprises a locking mechanism to secure the projection 110 with respect to the particular detent groove 104. The locking mechanism ensures that once the cylindrical telescoping member 106 is adjusted to the desired position, the projection 110 firmly engages with the detent groove 104 and remains locked in the desired position, thereby stabilizing the cylindrical telescoping member 106 and preventing inadvertent movement. Such a mechanism enhances the stability and reliability of the bustle device 100 by providing a secure locking function that maintains the selected adjustment setting, thus contributing to a consistent shape and support for the garment.

In another embodiment, the U-shaped member 114 comprises an elongate extension member. The elongate extension member is disposed at an angle between 0° to 90° with respect to the cylindrical telescoping member 106. The elongate extension member enables to provide additional lift to the bottom side of the garment, thereby protecting the bottom side from coming into contact with environmental factors such as water puddles, dust, grease and the like. The disposition of the elongate extension member at different angles allows for flexible positioning of the elongate extension member 120, enabling to adapt to different garment designs and styles. For example, the elongate extension member 120 can be angled in an upward manner such that the elongate extension member is disposed at an angle of 5° with respect to the cylindrical telescoping member 106. Such an angle of the elongate extension member enables the elongate extension member to be disposed substantially parallely to the cylindrical telescoping member 106. Consequently, the disposition of the elongate extension member at different angles enables the bustle device 100 to conform to the specific shape and fall of the garment and improving the overall fit and appearance thereof for various styles of garments.

In yet another embodiment, the first connector 112 is hingedly connected to the cylindrical telescoping member 106 and the second connector 118 is hingedly connected to the U-shaped member 114. The hingedly connected first connector 112 allows enables limited range of movement of the garment during usage of the bustle device 100, enhancing comfort and flexibility associated with the usage. Similarly, the hingedly connected second connector 118 enables flexibility in positioning of the bottom side of the garment, facilitating natural movement or flow of the garment and increasing aesthetic appeal associated therewith. For example, when the bustle device 100 is worn under a wedding dress, the hinged connection of the first connection 112 and the second connector 118 enables the wedding dress to move naturally with movement of the wearer, thus, improving aesthetic appeal associated with wearing of the wedding dress with the bustle device 100 underneath.

In an embodiment, the first connector 112 is detachably connected to the cylindrical telescoping member 106 and the second connector 118 is detachably connected to the U-shaped member 114. Such a detachable connection allows for easy replacement of either the first connector 112 or the second connector 119 in an event of damage or wear, enhancing the overall durability and longevity of the bustle device 100. For example, if the first connector 112 becomes broken or worn out, the first connector 112 can be readily replaced with a new one without requiring the replacement of the entire bustle device 100. Such a detachable connection supports the reuse of the bustle device 100 and extends an operational life thereof, making the bustle device 100 a more sustainable and cost-effective solution for users.

In another embodiment, each of the first connector 112 and the second connector 118 is selected from a clip, a hook, a snap fastener, a magnetic fastener, a hook-and-loop fastener (such as VELCRO® fastener), a button, a buckle and a clamp. Such a selection of the of the first connector 112 and the second connector 118 from various connector types allows for versatile attachment options based on user preference or garment type. For example, when the first connector 112 is a buckle and the second connector 118 is a magnetic fastener, the first connector 112 can be easily attached to a belt and the second connector 118 can be attached to a shoe, thereby simplifying the connection process and providing a secure yet easily detachable attachment. Such flexibility enhances the convenience of using the bustle device 100 with different garments and accessories, adapting to various user needs and preferences.

In yet another embodiment, the U-shaped member 114 is telescopically disposed within the second end 116 of the cylindrical detent casing 102. Such a telescoping feature provides additional adjustment capabilities, allowing the U-shaped member 114 to extend or retract to accommodate different garment lengths and sizes. For example, the telescoping mechanism increases the usability of the bustle device 100 by enabling the bustle device 100 to be adjusted to fit both tall and short individuals. Thus, the adjustability ensures that the bustle device 100 can provide effective support and maintain the desired garment shape across a wide range of users, thereby enhancing overall versatility and user-friendliness associated therewith.

Figure 2:
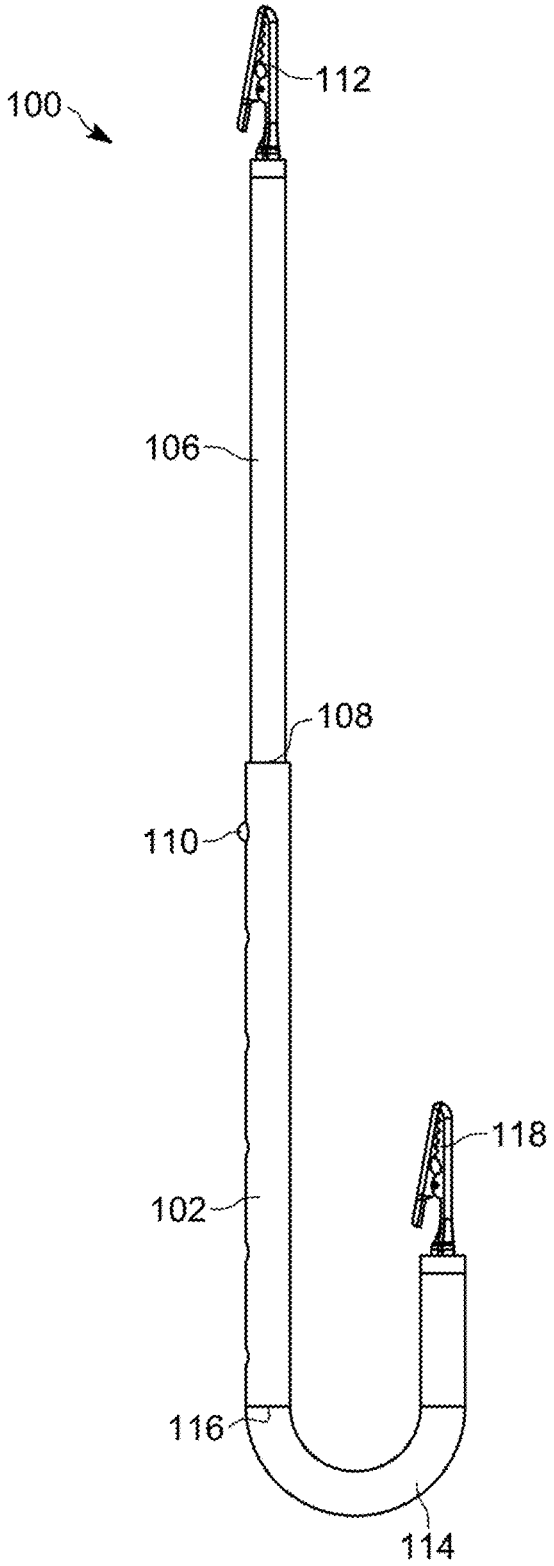
FIG. 2 shows a left-hand side view of the bustle device of FIG. 1, in accordance with an embodiment of the present disclosure.

Referring to FIG. 2, there is shown a left-hand side view of the bustle device 100 of FIG. 1, in accordance with an embodiment of the present disclosure.

Figure 3:
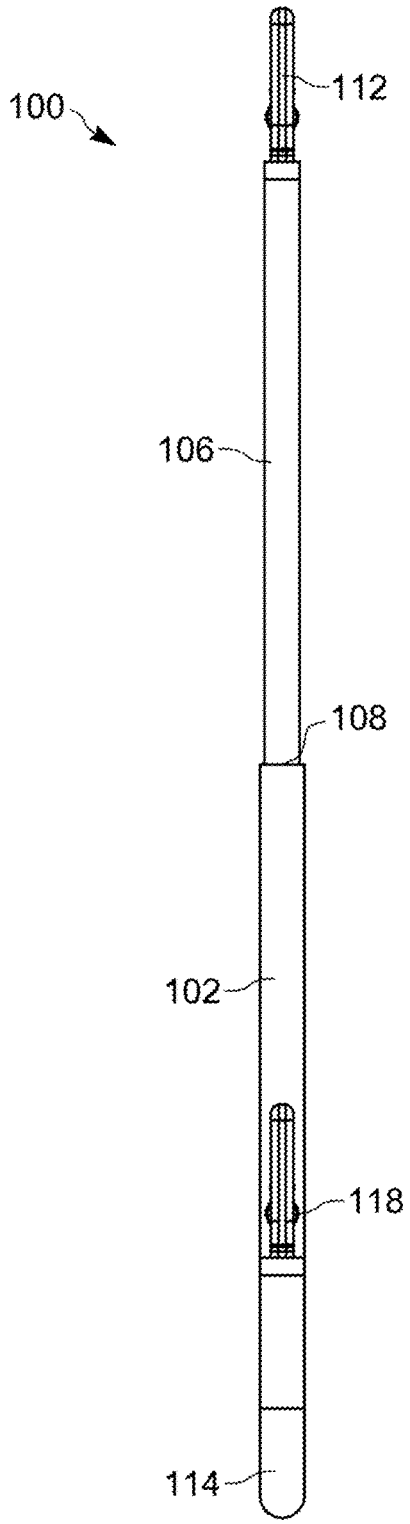
FIG. 3 shows a rear side view of the bustle device of FIGS. 1-2, in accordance with an embodiment of the present disclosure.

Referring to FIG. 3, there is shown a rear side view of the bustle device 100 of FIGS. 1-2, in accordance with an embodiment of the present disclosure.

Figure 4:
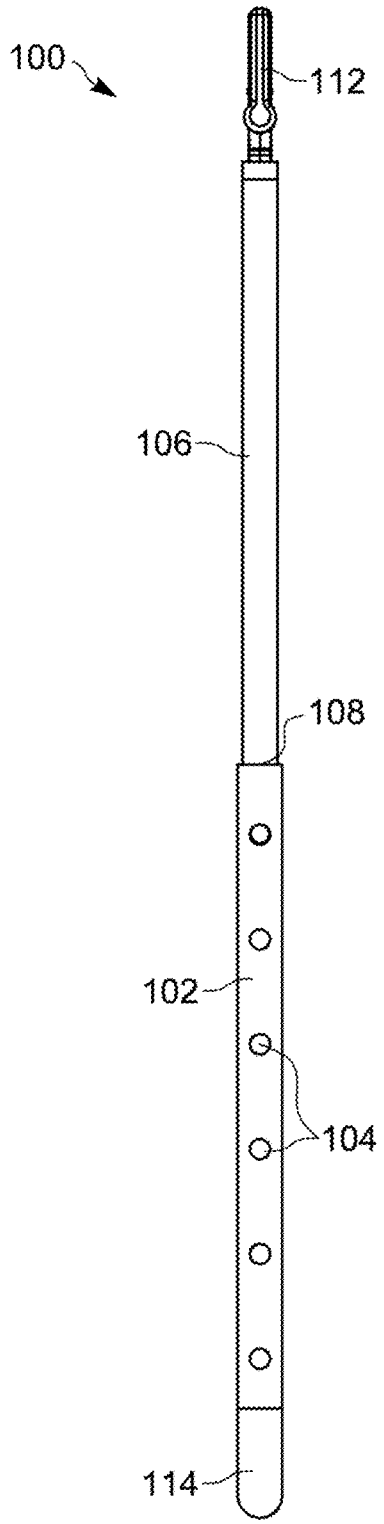
FIG. 4 shows a front side view of the bustle device of FIGS. 1-3, in accordance with an embodiment of the present disclosure.

Referring to FIG. 4, there is shown a front side view of the bustle device 100 of FIGS. 1-3, in accordance with an embodiment of the present disclosure.

Figure 5:
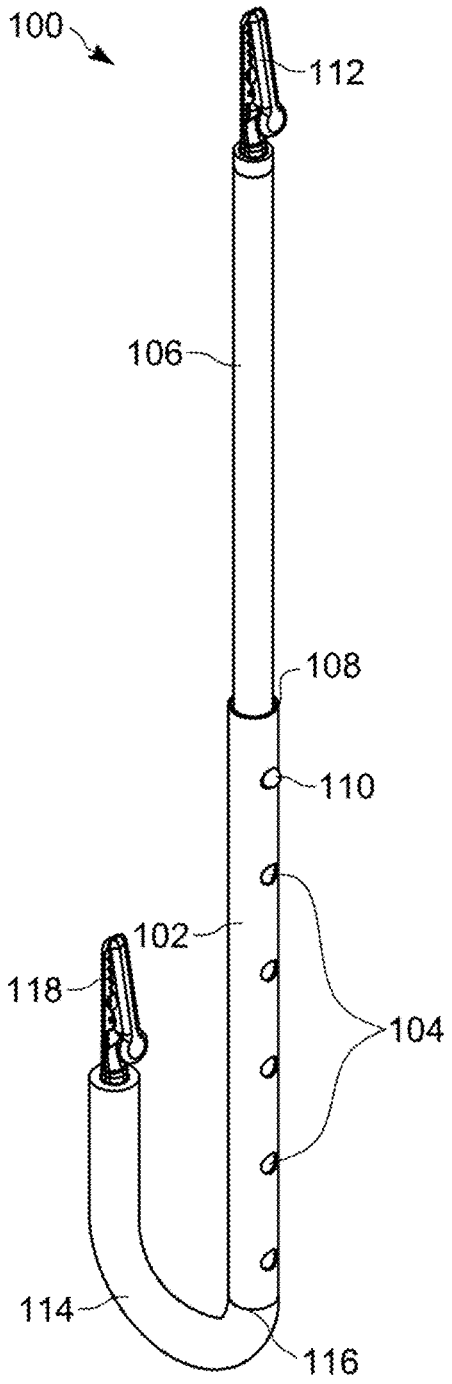
FIG. 5 shows a rear perspective view of the bustle device of FIGS. 1-4, in accordance with an embodiment of the present disclosure.

Referring to FIG. 5, there is shown a rear perspective view of the bustle device 100 of FIGS. 1-4, in accordance with an embodiment of the present disclosure.

Figure 6:
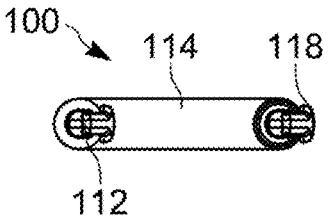
FIG. 6 shows a top view of the bustle device of FIGS. 1-5, in accordance with an embodiment of the present disclosure.

Referring to FIG. 6, there is shown a top view of the bustle device 100 of FIGS. 1-5, in accordance with an embodiment of the present disclosure.

Figure 7:
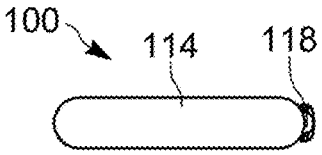
FIG. 7 shows a bottom view of the bustle device of FIGS. 1-6, in accordance with an embodiment of the present disclosure.

Referring to FIG. 7, there is shown a bottom view of the bustle device 100 of FIGS. 1-6, in accordance with an embodiment of the present disclosure.

Figure 8:
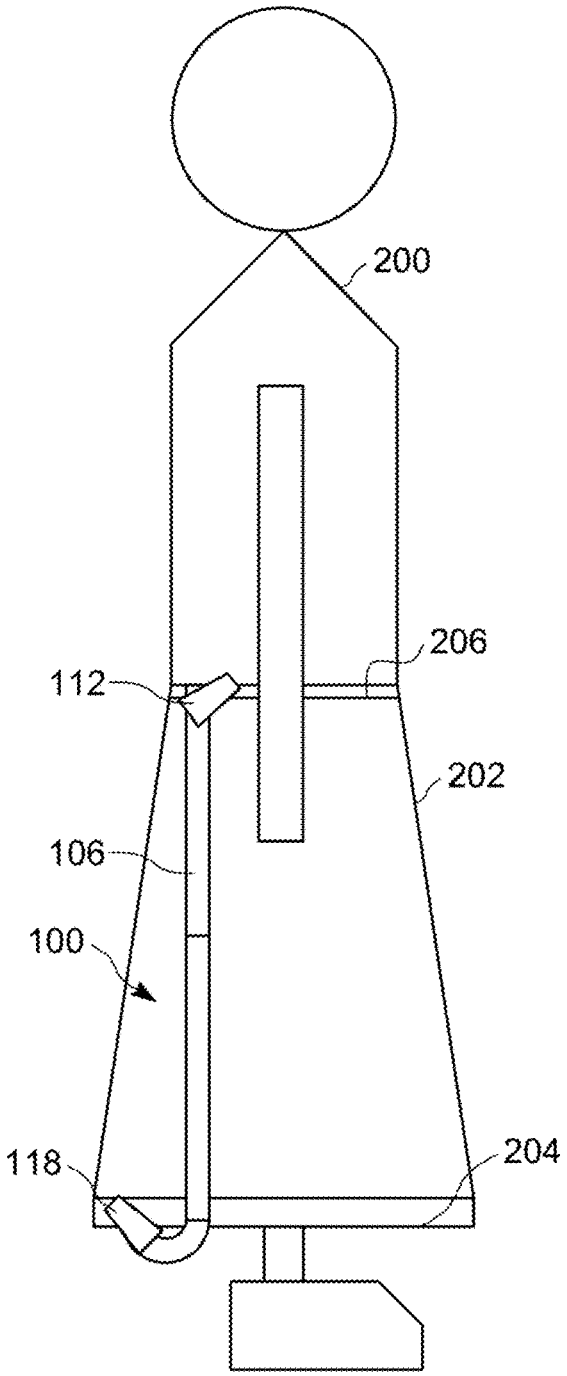
FIG. 8 shows an illustration of an exemplary usage scenario of the bustle device 100 of FIGS. 1-7, in accordance with an embodiment of the present disclosure.

Referring to FIG. 8, there is shown an illustration of an exemplary usage scenario of the bustle device 100 of FIGS. 1-7, in accordance with an embodiment of the present disclosure. As shown, a user 200 wearing a long skirt 202 employs the bustle device 100 to enhance a silhouette associated with the long skirt 202 and protect a lower hem (or frill) of the long skirt 202. The user attaches the first connector 112 of the cylindrical telescoping member 106 to a top side of the skirt, such as a waistline 206 of the long skirt 202 and the second connector 118 of the U-shaped member 114 to a bottom side of the skirt, such as the lower hem 204 of the long skirt 202. Such an arrangement of the bustle device 100 under the long skirt 202 prevents the lower hem 204 from dragging on the ground, reducing risk of damage from contact with water, dust or other environmental elements. The adjustable nature of the cylindrical telescoping member 106 allows for modifications in a profile of the bustle device 100 as well as that of the long skirt 202 to suit different styling needs or personal preferences, ensuring both practical protection and aesthetic enhancement for the garment. Thus, the bustle device 100 enables to supports the structure and shape of the long skirt 202 while preventing damage to the skirt 202 from damaging environmental factors, thereby, improving aesthetic appeal associated therewith.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of embodiments, those skilled in the art will recognize that the embodiments herein can be practiced with modification within the spirit and scope of the embodiments as described herein.

The foregoing description and accompanying figures illustrate the principles, embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

The terms "comprises", "comprising", "includes", "including", "having" and their conjugates mean "including but not limited to" and indicate that the components listed are included, but not generally to the exclusion of other components. Such terms encompass the terms "consisting of" and "consisting essentially of".

The phrase "consisting essentially of" means that the composition or method may include additional ingredients and/or steps, but only if the additional ingredients and/or steps do not materially alter the basic and novel characteristics of the composition or method.

As used herein, the singular form "a", "an" and "the" may include plural references unless the context clearly dictates otherwise. For example, the term "a compound" or "at least one compound" may include a plurality of compounds, including mixtures thereof.

The word "exemplary" is used herein to mean "serving as an example, instance or illustration". Any embodiment described as "exemplary" is not necessarily to be construed as preferred or advantageous over other embodiments or to exclude the incorporation of features from other embodiments.

The word "optionally" is used herein to mean "is provided in some embodiments and not provided in other embodiments". Any particular embodiment of the disclosure may include a plurality of "optional" features unless such features conflict.

It is appreciated that certain features of the disclosure, which are, for clarity, described in the context of separate embodiments, may also be provided in combination in a single embodiment. Conversely, various features of the disclosure, which are, for brevity, described in the context of a single embodiment, may also be provided separately or in any suitable sub-combination or as suitable in any other described embodiment of the disclosure. Certain features described in the context of various embodiments are not to be considered essential features of those embodiments, unless the embodiment is inoperative without those elements.

Although the disclosure has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the disclosure.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present disclosure. To the extent that section headings are used, they should not be construed as necessarily limiting.

The invention claimed is:

1. A bustle device to be received under a garment, wherein the bustle device comprises:

a cylindrical detent casing comprising a plurality of detent grooves, wherein the cylindrical detent casing is hollow;

a cylindrical telescoping member movably disposed at a first end of the cylindrical detent casing, wherein the cylindrical telescoping member comprises a projection to be received into a particular detent groove of the plurality of detent grooves of the cylindrical detent casing and wherein the cylindrical telescoping member comprises a first connector to be detachably connected to a top side of a garment; and a U-shaped member connected to a second end of the cylindrical detent casing, wherein the U-shaped member comprises a second connector to be detachably connected to a bottom side of a garment.

2. The bustle device as claimed in claim 1, wherein each detent groove of the plurality of detent grooves is disposed equidistantly from one another along the cylindrical detent casing.

3. The bustle device as claimed in claim 1, wherein the projection is selected from: a ball projection, a pin projection, a hook projection, a magnetic projection.

4. The bustle device as claimed in claim 1, wherein the projection is spring-loaded with respect to the cylindrical telescoping member.

5. The bustle device as claimed in claim 1, wherein the bustle device comprises a locking mechanism to secure the projection with respect to the particular detent groove.

6. The bustle device as claimed in claim 1, wherein the U-shaped member comprises an elongate extension member and wherein the elongate extension member is disposed at an angle between 0° to 90° with respect to the cylindrical telescoping member.

7. The bustle device as claimed in claim 1, wherein the first connector is hingedly connected to the cylindrical telescoping member and the second connector is hingedly connected to the U-shaped member.

8. The bustle device as claimed in claim 1, wherein the first connector is detachably connected to the cylindrical telescoping member and the second connector is detachably connected to the U-shaped member.

9. The bustle device as claimed in claim 1, wherein each of the first connector and the second connector is selected from: a clip, a hook, a snap fastener, a magnetic fastener, a hook and loop fastener, a button, a buckle and a clamp.

10. The bustle device as claimed in claim 1, wherein U-shaped member is telescopically disposed within the second end of the cylindrical detent casing.

* * * * *